United States Patent [19]

Buljan et al.

[11] Patent Number: 5,053,074

[45] Date of Patent: Oct. 1, 1991

[54] CERAMIC-METAL ARTICLES

[75] Inventors: Sergej T. Buljan, Acton; Helmut Lingertat, Dorchester; Steven F. Wayne, Scituate, all of Mass.

[73] Assignee: GTE Laboratories Incorporated, Waltham, Mass.

[21] Appl. No.: 632,237

[22] Filed: Dec. 20, 1990

Related U.S. Application Data

[63] Continuation-in-part of Ser. No. 576,241, Aug. 31, 1990, abandoned.

[51] Int. Cl.[5] ..... C22C 29/02

[52] U.S. Cl. ..... 75/236; 75/232; 75/233; 75/234; 75/235; 75/237; 75/238; 75/240; 75/241; 75/239; 75/242; 75/244

[58] Field of Search ..... 75/232, 233, 234, 235, 75/236, 237, 238, 240, 241, 239, 242, 244

[56] References Cited

U.S. PATENT DOCUMENTS

| | | | |
|---|---|---|---|
| 3,653,882 | 4/1972 | Petrasek et al. | 419/49 |
| 3,696,486 | 10/1972 | Benjamin | 75/206 |
| 4,173,685 | 11/1979 | Weatherly | 75/238 |
| 4,507,263 | 3/1985 | Ron | 419/49 |
| 4,615,735 | 10/1986 | Ping | 419/49 |
| 4,650,519 | 3/1987 | Change et al. | 75/244 |
| 4,676,829 | 6/1987 | Change et al. | 75/244 |
| 4,847,044 | 7/1989 | Ghosh | 419/10 |
| 4,919,718 | 4/1990 | Tiegs et al. | 75/232 |

OTHER PUBLICATIONS

S. Sridharan et al., "Investigations Within the Quarternary System Titanium-Nickel-Aluminum-Carbon", *Monatshefte fur Chemie*, 114, 127-135 (1983).

A. V. Tumanov et al., "Wetting of TiC-WC System Carbides with Molten $Ni_3Al$", pp. 428-430 of translation from *Poroshkovaya Metallurgiya*, 5(281), pp. 83-86 (May 1986).

*Primary Examiner*—Robert L. Stoll
*Assistant Examiner*—Leon Nigohosian
*Attorney, Agent, or Firm*—Frances P. Craig

[57] ABSTRACT

A dense cermet article including about 80-90% by volume of a granular hard phase and about 5-20% by volume of a metal phase. The hard phase is a carbide, nitride, carbonitride, oxycarbide, oxynitride, or carboxynitride of a cubic solid solution selected from W-Ti, W-Hf, W-Nb, W-Ta, Zr-Ti, Hf-Ti, Hf-Zr, V-Ti, Nb-Ti, Ta-Ti, or Mo-Ti. The metal phase consists essentially of a combination of nickel and aluminum having a ratio of nickel to aluminum of from about 90:10 to about 70:30 by weight, and 0-5% by weight of an additive selected from titanium, zirconium, hafnium, vanadium, niobium, tantalum, chromium, molybdenum, tungsten, cobalt, boron, and/or carbon. The preferred hard phase is a cubic solid solution of tungsten and titanium. In the preferred metal phase, an amount of about 15-80% by volume of the metal phase component exhibits a $Ni_3Al$ ordered crystal structure. The article may be produced by presintering the hard phase - metal phase component mixture in a vacuum or inert atmosphere at about 1475°-1675° C., then densifying by hot isostatic pressing at a temperature of about 1575°-1675° C., in an inert atmosphere, and at about 34-207 MPa pressure. Limiting the presintering temperature to 1475°-1575° C. and keeping the presintering temperature at least 50° C. below the hot pressing temperature produces an article of gradated hardness, harder at the surface than at the core.

18 Claims, 3 Drawing Sheets

CERAMIC-METAL ARTICLES

This is a continuation-in-part of U.S. patent application Ser. No. 07/576,241, filed Aug. 31, 1990, now abandoned.

BACKGROUND OF THE INVENTION

This invention relates to metal bonded ceramic, e.g. carbide, nitride, and carbonitride, articles for use as cutting tools, wear parts, and the like. In particular the invention relates to such articles bonded with a metal phase including both nickel and aluminum.

The discovery and implementation of cobalt bonded tungsten carbide (WC-Co) as a tool material for cutting metal greatly extended the range of applications beyond that of conventional tool steels. Over the last 50 years process and compositional modifications to WC-Co materials have led to further benefits in wear resistance, yet the potential of these materials is inherently limited by the physical properties of the cobalt binder phase. This becomes evident when cutting speeds are increased to a level which generates sufficient heat to soften the metal binder. The high speed finishing of steel rolls serves as an example of a metal cutting application where the tool insert must maintain its cutting edge geometry at high temperature and resist both wear and deformation.

Unfortunately, the wear characteristics of WC-Co based cemented carbides are also affected by the high temperature chemical interaction at the interface between the ferrous alloy workpiece and the cemented carbide tool surface. Additions of cubic carbides (i.e. TiC) to the WC-Co system have led to some improvement in tool performance during steel machining, due in part to the resulting increased hardness and increased resistance to chemical interaction. However, the performance of such TiC-rich WC-Co alloys is influenced by the low fracture toughness of the TiC phase, which can lead to a tendency toward fracture during machining operations involving intermittent cutting, for example milling.

Accordingly, a ceramic-metal material suitable for cutting tools capable of withstanding the demands of hard steel turning (wear resistance) and steel milling (impact resistance) would be of great value. Such a new and improved material is described herein.

SUMMARY OF THE INVENTION

In one aspect, the present invention is a ceramic-metal article including about 80–95% by volume of a granular hard phase and about 5–20% by volume of a metal phase. The hard phase consists essentially of a ceramic material selected from the carbides, nitrides, carbonitrides, oxycarbides, oxynitrides, and carboxynitrides of a cubic solid solution selected from the group consisting of zirconium-titanium, hafnium-titanium, hafnium-zirconium, vanadium-titanium, niobium-titanium, tantalum-titanium, molybdenum-titanium, tungsten-titanium, tungsten-hafnium, tungsten-niobium, and tungsten-tantalum. The metal phase consists essentially of a combination of nickel and aluminum having a ratio of nickel to aluminum of about 90:10 to 70:30, preferably about 85:15 to about 88:12, by weight, and 0–5% by weight of an additive selected from the group consisting of titanium, zirconium, hafnium, vanadium, niobium, tantalum, chromium, molybdenum, tungsten, cobalt, boron, carbon, and combinations thereof. The article has a density of at least about 95% of theoretical.

In a narrower aspect, the hard phase consists essentially of a ceramic material selected from the carbides, nitrides, carbonitrides, oxycarbides, oxynitrides, and carboxynitrides of a cubic solid solution of tungsten and titanium.

In another narrower aspect, the article has a hardness gradated from a greater hardness at its surface to a lesser hardness at its core.

In yet other narrower aspects, the metal phase consists essentially of a $Ni_3Al$ ordered crystal structure, or comprises a $Ni_3Al$ ordered crystal structure in amounts of about 15–80% by volume.

BRIEF DESCRIPTION OF THE DRAWINGS

For a better understanding of the present invention, together with other objects, advantages and capabilities thereof, reference is made to the following Description and appended Claims, together with the Drawing, in which:

DETAILED DESCRIPTION OF THE PREFERRED EMBODIMENTS

Figure 1:
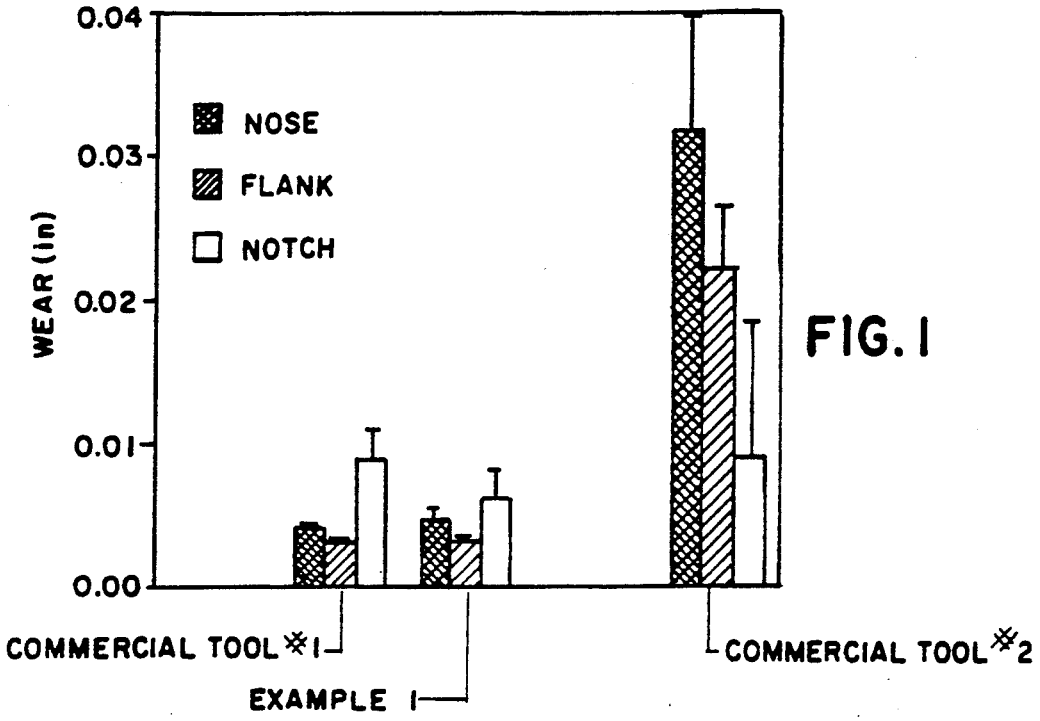
FIG. 1 is a graphical representation comparing the machining performance of a cutting tool shaped article according to one aspect of the invention and commercially available tools.

The ceramic-metal materials described herein include one or more hard refractory cubic solid solution metal carbides, nitrides, oxycarbides, oxynitrides, carbonitrides, and carboxynitrides bonded by a metallic phase combining nickel and aluminum. The hard phase compounds include such solid solution metal combinations as zirconium and titanium, hafnium and titanium, hafnium and zirconium, vanadium and titanium, niobium and titanium, tantalum and titanium, molybdenum and titanium, tungsten and titanium, tungsten and hafnium, tungsten and niobium, or tungsten and tantalum. Of these, the combinations including solid solutions of tungsten with titanium, hafnium, niobium, or tantalum are preferred, with the tungsten-titanium solid solutions being the most preferred.

The following description relates to a preferred densified, metal bonded hard ceramic body or article prepared from a powder mixture; the invention, however, is not limited to these formulations. The powder mixture contains solid solution powders of $(W_xTi_{1-x})C$, $(W_xTi_{1-x})N$, $(W_xTi_{1-x})(C,N)$, $(W_xTi_{1-x})(O,C)$, $(W_xTi_{1-x})(O,N)$, or $(W_xTi_{1-x})(O,C,N)$, or combinations thereof as the hard phase component, and a combination of both Ni powder and Al powder in an amount of about 5–20% by volume as the metal component. Preferably, x is a weight fraction of about 0.3–0.7. The best combination of properties (hardness and fracture toughness) is obtained when total metallic phase addition is in the range of about 7–15% by volume.

For best results in sintering and in both physical and chemical property balance, the ratio in the solid solution hard phase of tungsten to titanium should be in the range of about 0.3–3.0 and more preferably about 0.6–1.5. Materials with a W:Ti ratio lower than about 0.3 exhibit lowered fracture toughness and impact resistance, which can be important in some applications, e.g. when used as cutting tools for steel milling. A ratio of about 3.0 or more can reduce wear resistance, which can also be important in some applications, e.g. when used as cutting tools for steel turning.

As stated above, the metal powder represents about 5–20% by volume and preferably about 7–15% by volume of the total starting formulation. The metallic powder includes nickel in an amount of about 70–90% by weight, and aluminum in total weight of the metal powder. A minor amount of titanium, zirconium, hafnium, vanadium, niobium, tantalum, chromium, molybdenum, tungsten, cobalt, boron and/or carbon, not to exceed about 5% by weight of total metal phase, may also be included. The preferred composition is 12–14% by weight Al, balance Ni. In the most preferred compositions the Ni:Al ratio results in the formation of a $Ni_3Al$ phase, having the $Ni_3Al$ ordered crystal structure. This phase may be present in a minor amount (less than 50% by volume) of the metal phase, or in an amount of 40–80% by volume of the metal phase, or some compositions may consist essentially of this phase. In some compositions, this ordered crystal structure may coexist or be modified by the above-mentioned additives. The amount of $Ni_3Al$ in the metal phase is also dependent on the processing, e.g. the processing temperatures. The ratio of Ni:Al required to produce the desired composition of the metal phase, however, may be readily determined empirically for a given set of processing parameters.

The preferred average grain size of the hard phase in a densified body of this material for cutting tool use is about 0.5–5.0 μm. In other articles for applications where deformation resistance requirements are lower, e.g. sand blasting nozzles, a larger range of grain sizes, e.g. about 0.5–20 μm, may prove satisfactory. The material may be densified by known methods, for example sintering, continuous cycle sinter-hip, two step sinter-plus-HIP, or hot pressing, all known in the art.

Another preferred densified, metal bonded hard ceramic body or article has the same overall composition as described above, but differs in that it exhibits a gradated hardness, most preferably exhibiting lower hardness in the center portion of the body and progressively increasing hardness toward the tool surface. To obtain a body with these characteristics, the densification process includes a presintering step in which the starting powder mixture is subjected to temperatures of about 1475°–1575° C., preferably 1475°–1550° C., in vacuum (e.g. about 0.1 Torr) or in an inert atmosphere (e.g. at about 1 atm) for a time sufficient to develop a microstructure with closed porosity, e.g. about 0.5–2 hr. As used herein, the term "microstructure with closed porosity" is intended to mean a microstructure in which the remaining pores are no longer interconnected. Subsequently, the body is fully densified in an inert atmospheric overpressure of about 34–207 MPa and temperature of about 1575°–1675° C., preferably 1600°–1675° C., for a time sufficient to achieve full density, e.g. about 0.5–2 hr. The presintering temperature is at least 50° C. lower than the final densification temperature. These gradated bodies exhibit outstanding impact resistance, and are particularly useful as milling tool inserts and as tools for interrupted cutting of steel.

The depth to which the gradated hardness is effected is dependent on the presintering temperature. Thus, if a gradated hardness is not required a similar process, but with a broader range of presintering temperatures, about 1475°–1675° C., may be used, and a 50° C. difference between the presintering and hot isostatic pressing temperatures is not necessary.

For certain applications such as cutting tools the articles described herein may be coated with refractory materials to provide certain desired surface characteristics. The preferred coatings have one or more adherent, compositionally distinct layers of refractory metal carbides, nitrides, and/or carbonitrides, e.g. of titanium, tantalum, or hafnium, or oxides, e.g. of aluminum or zirconium, or combinations of these materials as different layers and/or solid solutions. Such coatings may be deposited by methods such as chemical vapor deposition (CVD) or physical vapor deposition (PVD), and preferably to a total thickness of about 0.5–10 μm. CVD or PVD techniques known in the art to be suitable for coating cemented carbides are preferred for coating the articles described herein.

Coatings of alumina, titanium carbide, titanium nitride, titanium carbonitride, hafnium carbide, hafnium nitride, or hafnium carbonitride are typically applied by CVD. The other coatings described above may be applied either by CVD techniques, where such techniques are applicable, or by PVD techniques. Suitable PVD techniques include but are not limited to direct evaporation and sputtering. Alternatively, a refractory metal or precursor material may be deposited on the above-described bodies by chemical or physical deposition techniques and subsequently nitrided and/or carburized to produce a refractory metal carbide, carbonitride, or nitride coating. Useful characteristics of the preferred CVD method are the purity of the deposited coating and the enhanced layer adherency often produced by diffusional interaction between the layer being deposited and the substrate or intermediate adherent coating layer during the early stages of the deposition process.

For certain applications, for example cutting tools, combinations of the various coatings described above may be tailored to enhance the overall performance, the combination selected depending, for cutting tools, on the machining application and the workpiece material. This is achieved, for example, through selection of coating combinations which improve adherence of coating to substrate and coating to coating, as well as through improvement of microstructurally influenced properties of the substrate body. Such properties include hardness, fracture toughness, impact resistance, and chemical inertness of the substrate body.

The following Examples are presented to enable those skilled in the art to more clearly understand and practice the present invention. These Examples should not be considered as a limitation upon the scope of the present invention, but merely as being illustrative and representative thereof.

EXAMPLES

Cutting tools were prepared from a powder mixture of 10% by volume metal binder (86.7% Ni, 13.3% Al, both by weight) and 90% by volume hard phase.

A charge of 111.52 g of the carbide and metal powder mixture, 0.0315 g of carbon, 4.13 g of paraffin, and 150 cc of heptane was milled in a 500 cc capacity tungsten carbide attritor mill using 2000 g of 3.2 mm cemented tungsten carbide ball media for 2½ hr at 120 rpm. After milling, the powder was separated from the milling media by washing with additional heptane through a stainless steel screen. The excess heptane was slowly evaporated. To prevent binder (wax) inhomogeneity, the thickened slurry was mixed continuously during evaporation, and the caking powder broken up with a plastic spatula into small, dry granules. The dry granules were then sieved in two steps using 40- and 80-mesh screens. The screened powder was then pressed at 138 MPa, producing green compacts measuring 16×16×6.6 mm and containing 50–60% by volume of solids loading.

The pressed compacts were placed in a graphite boat, covered with alumina sand, and placed in a hydrogen furnace at room temperature. The temperature then was raised in increments of 100° every hour and held at 300° C. for 2 hr to complete the removal of the organic binder. The dewaxed samples were then taken from the hot zone, cooled to room temperature, and removed from the hydrogen furnace. These dewaxed samples were then densified as described below.

EXAMPLE 1

The densification of a compact prepared as described above, having as a hard phase (W,Ti)C cubic solid solution in a 50:50 ratio by weight W:Ti, was carried out in two steps: presintering and hot isostatic pressing (HIPing). The dewaxed compacts, on graphite plates which had been sprinkled with coarse alumina sand, were presintered at 1650° C. for 1 hr at about 0.1 Torr in a cold wall graphite vacuum furnace. The initial rise in temperature was rapid, 15° C./min up to 800° C. From 800° C. the rise was reduced to 4.5° C./min. Throughout the entire presintering cycle, the chamber pressure was maintained at about 0.1 Torr.

The final consolidation was carried out in a HIP unit at 1650° C. and 207 MPa of argon for 1 hr, using a heating rate of about 10° C./min. The maximum temperature (1650° C.) and pressure (207 MPa) were reached at the same time and were maintained for about 1 hr, followed by oven cooling to room temperature. Cutting tools prepared by this process exhibited improved performance over that of commercially available cutting tools in machining of steel, as shown in FIG. 1. The tools were used in the dry turning of 1045 steel, 600 ft/min, 0.016 in/rev, 0.050 in D.O.C. (depth of cut). The wear values shown in FIG. 1 are averages of the wear induced at three corners; 29.1 $in^3$ of metal were removed. As may be seen in performance with commercial tool #1, showing significantly superior notch wear, and was far superior to commercial tool #2. The composition and room temperature hardness of the commercial materials of FIG. 1 and of the tools of Example 1 are compared in Table 1 below.

TABLE 1

| Sample | Composition | Hardness* Knoop, GPa |
|---|---|---|
| Example 1 | (W,Ti)C + 10 v/o** (Ni + Al) | 15.4 ± 0.3 |
| Commercial Tool #1 | TiC 10 Ni + 10 Mo (v/o) | 14.5 ± 0.2 |
| Commercial Tool #2 | 10 Co + 10 Ni + 80 other (v/o) | 13.4 ± 0.2 |

*1.0 N Load.
**v/o = volume percent.
MoC, TiC, TiN, VC, WC (proprietary composition).

EXAMPLE 2

Cutting tools were prepared as described above for Example 1, using the same hard phase/metal phase powder ratio, except that the dewaxed compacts were presintered at 1500° C. for 1 hr. at 0.1 Torr in the same cold wall graphite vacuum furnace. The rise in temperature was the same as in Example 1: initially rapid, 15° C./min. up to 800° C. From 800° C., the rise was reduced to 4.5° C./min.

Figure 2:
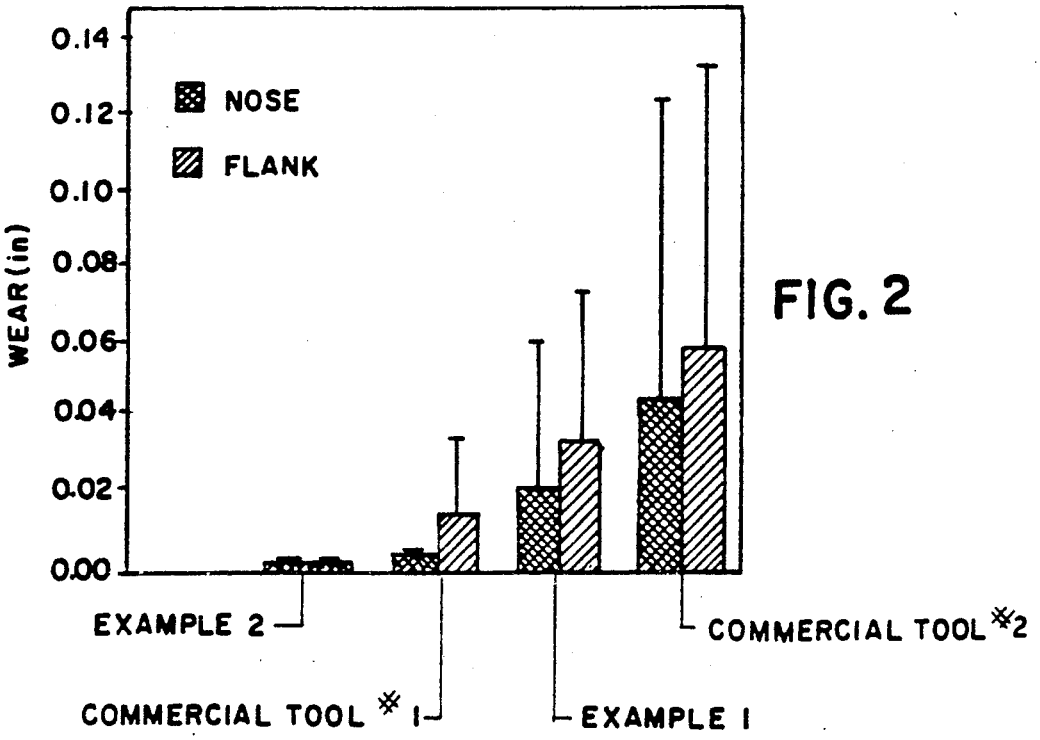
FIG. 2 is a graphical representation comparing the milling performance of cutting tool shaped articles according to two aspects of the invention and commercially available tools.

The metal bonded carbide cutting tool of Example 2 was characterized by a specific microstructure in which a gradient of hardness was developed from the surface of the densified article to its core. The Knoop hardness at the surface and the core under 0.5N loads were 20.34 GPa and 18.10 GPa respectively. The performance of the gradated cutting tool material was measured by machining tests, the results of which are shown in FIG. 2. The impact resistances of the tool of this Example (with gradated hardness), the tool of Example 1 (without gradated hardness), and two commercial grade tools were determined by a dry flycutter milling test on a steel workpiece (Rockwell hardness, $R_c=24$) using a standard milling cutter (available from GTE Valenite Corporation, Troy, Mich., U.S.A.) at 750 ft/min, 4.2 in/rev, 0.125 in D.O.C. The wear values shown in FIG. 2 are four corner averages at 341 impacts per corner. The specific cutting tools used in the machining tests are listed in Table 1 with their compositions and room temperature hardness.

As shown in FIG. 2, the tool of this Example was superior in milling performance to both commercial tools. Further, although the tool of Example 2 was most suitable for this application, the tool of Example 1 also proved to have commercial value for such high impact machining.

EXAMPLES 3-6

Cutting tools were prepared as described above for Examples 1 and 2, using the same hard phase/metal phase powder ratio, but were presintered and some of them hot isostatically pressed at the temperatures and for the times shown in Table 2. The rise in temperature was the same as in Example 1: initially rapid, 15° C./min. up to 800° C. From 800° C., the rise was reduced to 4.5° C./min. Characterization by X-ray diffraction determined that the compacts evidenced varying amounts of γ' crystal structure $Ni_3Al$ formation in their metal phases.

TABLE 2

| Ex. | Composition | Sinter Temp., °C. | Sinter Time, hr | HIP Temp., °C. | HIP Time, hr |
|---|---|---|---|---|---|
| 3 | (W,TI)C + 10 v/o Ni-Al | 1650 | 1 | 1650 | 1 |
| 4 | (W,Ti)C + 10 v/o Ni-Al | 1550 | 1 | 1650 | 1 |
| 5 | (W,Ti)C + 10 v/o Ni-Al | 1650 | 1 | — | — |
| 6 | (W,Ti)C + 10 v/o Ni-Al | 1500 | 1 | — | — |

EXAMPLE 7

Ceramic-metal cutting tools with a nickel and aluminum metal phase were prepared as described above for Example 1, except that the compositions were as shown in Table 3. The performance of the cubic solid solution (W,Ti)C-based ceramic-metal cutting tools was compared to that of similar tools not containing solid solution carbide in the dry turning of 1045 steel, 475 ft/min, 0.012 in/rev, 0.050 in D.O.C. (depth of cut).

TABLE 3

| Ex. | Composition | Nose Wear, in | Flank Wear, in | Crater Wear, in | Metal Removed, $in^3$ |
|---|---|---|---|---|---|
| 7 | WC + 10 v/o Ni-Al | – | – | – | Tool failed |
| 8 | TiC + 10 v/o Ni-Al | 0.009 | 0.006 | <0.001 | 70 |
| 9 | Mixture WC + TiC* + 10 v/o Ni-Al | 0.0075 | 0.007 | 0.004 | 64.8 |
| 10 | Solid soln. (W,Ti)C* + 10 v/o Ni-Al | 0.008 | 0.0035 | <0.001 | 70 |

*W:Ti = 50:50 by weight.

The wear values shown in Table 3 are averages of the wear induced at three corners during extended cutting tests. The WC-based cermet tool failed before the extended cutting tests were completed. About 65–70 $in^3$ of metal were removed in the remaining tests. As shown in Table 3, the titanium carbide-based cermet tool was superior in extended wear performance to the similar tungsten carbide-based tool (which failed before the extended cutting test was completed), and surpassed the crater wear performance of a similar tool based on a mixture of tungsten carbide and titanium carbide.

The tool of Example 10 was similar in every way to those of Examples 7, 8, and 9, except that it included a cubic solid solution carbide of tungsten and titanium. The tools of Examples 9 and 10 were actually of an identical chemical composition, both including tungsten and titanium in a 50:50 weight ratio. Surprisingly, however, it was found that this solid solution carbide-containing tool outperformed the WC-based tool and even the (TiC+WC)-based tool in the showed superior flank wear performance and equivalent crater wear performance to the presumably harder TiC-based tool of Example 8.

Figure 3:
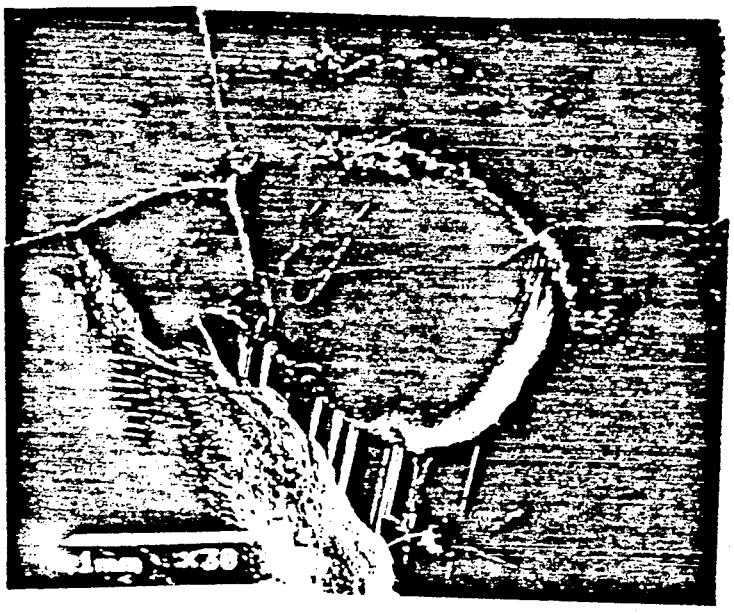
FIGS. 3–6 are photomicrographs illustrating wear characteristics of various tools of related compositions, including one tool according to one aspect of the invention.
Figure 4:
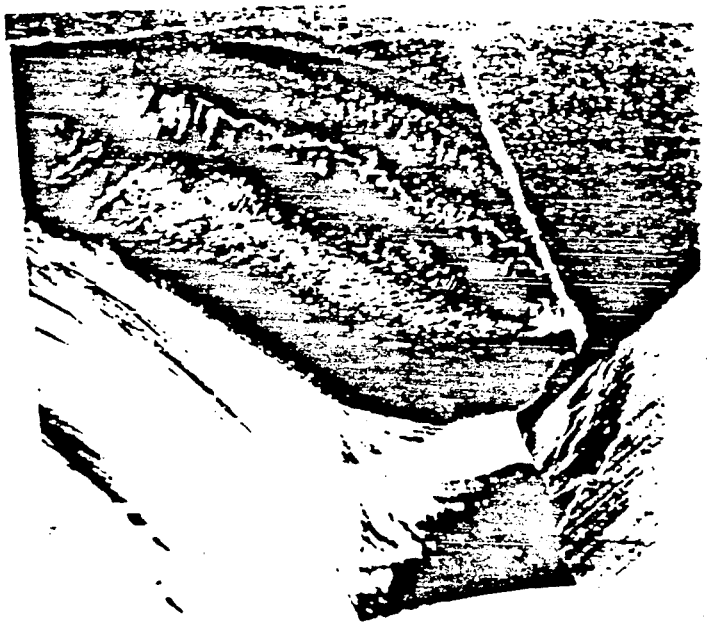
Figure 5:
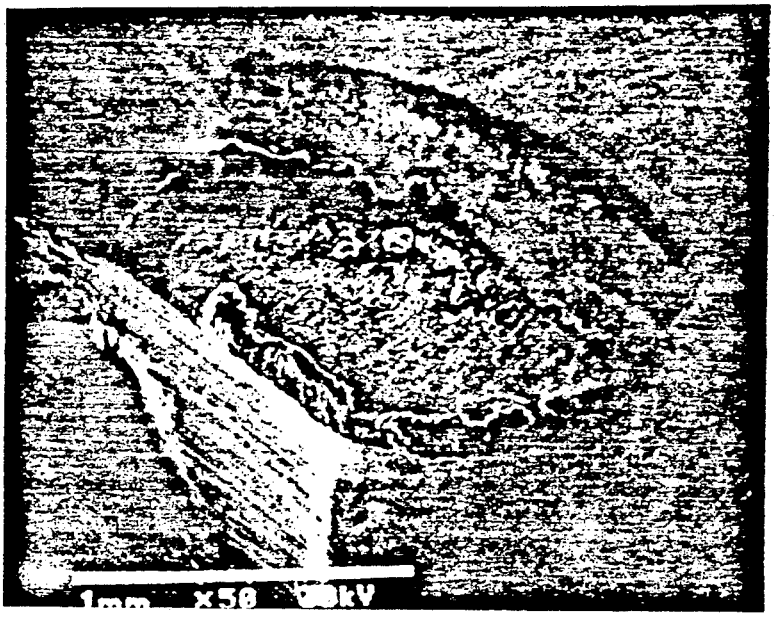
Figure 6:
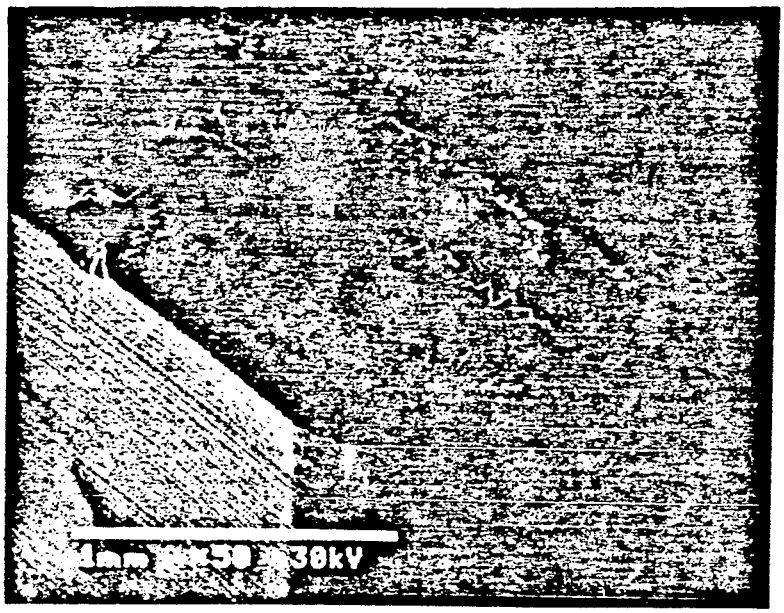

The surprising superiority of the cubic solid solution carbide-based tool may be clearly seen in FIGS. 3–6, which are photomicrographs of the wear induced at one corner of each of the tools listed in Table 3 after 20 $in^3$ of metal removal. As illustrated in FIG. 3, the tungsten carbide-based tool exhibits the severe cratering which ultimately led to failure of the tool. FIG. 4 illustrates the severe nose deformation of the titanium carbide-based tool; this tool, however, exhibits essentially no cratering. In FIG. 5 is illustrated the effect of combining the cratering resistance of titanium carbide with the resistance to nose deformation of tungsten carbide in the (WC+TiC)-based tool: the tool exhibits little deformation and only slight cratering. The superiority of the tool in accordance with one aspect of the invention, the solid solution carbide-based tool of Example 7 is illustrated in FIG. 6, in which the tool exhibits essentially no cratering and far less deformation and wear than any of the similar tools.

The present invention provides novel improved cutting tools capable of withstanding the demands of hard steel turning, which requires a high degree of wear resistance, and steel milling, which requires a high degree of impact resistance. It also provides wear parts and other structural parts of high strength and wear resistance.

While there has been shown and described what are at present considered the preferred embodiments of the invention, it will be obvious to those skilled in the art that various changes and modifications can be made therein without departing from the scope of the invention as defined by the appended Claims.

We claim:

1. A ceramic-metal article comprising:

about 80–95% by volume of a granular hard phase consisting essentially of a ceramic material selected from the carbides, nitrides, carbonitrides, oxycarbides, oxynitrides, and carboxynitrides of a cubic solid solution selected from the group consisting of zirconium-titanium, hafnium-titanium, hafnium-zirconium, vanadium-titanium, niobium-titanium, tantalum-titanium, molybdenum-titanium, tungsten-titanium, tungsten-hafnium, tungsten-niobium, and tungsten-tantalum; and about 5–20% by volume of a metal phase, wherein said metal phase consists essentially of a combination of nickel and aluminum having a ratio of nickel to aluminum of from about 90:10 to about 70:30 by weight and 0–5% by weight of an additive selected from the group consisting of titanium, zirconium, hafnium, vanadium, niobium, tantalum, chromium molybdenum, tungsten, cobalt, boron, carbon, and combinations thereof;

wherein said article has a density of at least about 95% of theoretical.

2. An article in accordance with claim 1 wherein said metal phase consists essentially of a $Ni_3Al$ ordered crystal structure or of a $Ni_3Al$ ordered crystal structure coexistent with or modified by said additive.

3. An article in accordance with claim 1 wherein said article has a surface hardness greater than its core hardness.

4. A ceramic-metal article comprising:

80–95% by volume of a granular hard phase consisting essentially or a ceramic material selected from the carbides, nitrides, carbonitrides, oxycarbides, oxynitrides, and carboxynitrides of a cubic solid solution selected from the group consisting of zirconium-titanium, hafnium-titanium, hafnium-zirconium, vanadium-titanium, niobium-titanium, tantalum-titanium, molybdenum-titanium, tungsten-titanium, tungsten-hafnium, tungsten-niobium, and tungsten-tantalum; and about 5–20% by volume of a metal phase, wherein said binder phase consists essentially of a combination of nickel and aluminum having a ratio of nickel to aluminum of from about 90:10 to about 70:30 by weight and 0–5% by weight of an additive selected from the group consisting of titanium, zirconium, hafnium, vanadium, niobium, tantalum, chromium, molybdenum, tungsten, cobalt, boron, carbon, and combinations thereof;

wherein said article has a hardness gradated from a greater hardness at its surface to a lesser hardness at its core and a density of at least about 95% of theoretical.

5. A ceramic-metal article comprising:

about 80–95% by volume of a granular hard phase consisting essentially of a ceramic material selected from the carbides, nitrides, carbonitrides, oxycarbides, oxynitrides, and carboxynitrides of a cubic solid solution selected from the group consisting of zirconium-titanium, hafnium-titanium, hafnium-zirconium, vanadium-titanium, niobium-titanium, tantalum-titanium, molybdenum-titanium, tungsten-titanium, tungsten-hafnium, tungsten-niobium, and tungsten-tantalum; and about 5–20% by volume of a metal phase, wherein said metal phase consists essentially of a combination of nickel and aluminum having a ratio of nickel to aluminum of from about 90:10 to about 70:30 by weight and 0–5% by weight of an additive selected from the group consisting of titanium, zirconium, hafnium, vanadium, niobium, tantalum, chromium, molybdenum, tungsten, cobalt, boron, carbon, and combinations thereof;

wherein said metal phase comprises a $Ni_3Al$ ordered crystal structure or a $Ni_3Al$ ordered crystal structure coexistent with or modified by said additive, in an amount of about 15–80% by volume of said metal phase, and said article has a density of at least about 95% of theoretical.

6. An article in accordance with claim 5 wherein said metal phase comprises a $Ni_3Al$ ordered crystal structure in an amount of less than about 50% by volume of said metal phase.

7. A ceramic-metal article comprising:

about 80–95% by volume of a granular hard phase consisting essentially of a ceramic material selected from the carbides, nitrides, carbonitrides, oxycarbides, oxynitrides, and carboxynitrides of a cubic solid solution of tungsten and titanium; and 5–20% by volume of a metal phase, wherein said metal phase consists essentially of a combination of nickel and aluminum having a ratio of nickel to aluminum of from about 90:10 to about 70:30 by weight and 0–5% by weight of an additive selected from the group consisting of titanium, zirconium, hafnium, vanadium, niobium, tantalum, chromium, molybdenum, tungsten, cobalt, boron, carbon, and combinations thereof;

wherein said article has a density of at least about 95% of theoretical.

8. An article in accordance with claim 7 wherein said hard phase consists essentially of a cubic solid solution tungsten titanium carbide.

9. An article in accordance with claim 7 wherein said metal phase comprises about 7–15% by volume of said article.

10. An article in accordance with claim 7 wherein said metal phase consists essentially of a $Ni_3Al$ ordered crystal structure or of a $Ni_3Al$ ordered crystal structure coexistent with or modified by said additive.

11. An article in accordance with claim 7 wherein said article has a surface hardness greater than its core hardness.

12. A ceramic-metal article comprising:

about 80–95% by volume of a granular hard phase consisting essentially of a ceramic material selected from the carbides, nitrides, carbonitrides, oxycarbides, oxynitrides, and carboxynitrides of a cubic solid solution of tungsten and titanium; and about 5–20% by volume of a metal phase, wherein said binder phase consists essentially of a combination of nickel and aluminum having a ratio of nickel to aluminum of from about 90:10 to about 70:30 by weight and 0–5% by weight of an additive selected from the group consisting of titanium, zirconium, hafnium, vanadium, niobium, tantalum, chromium, molybdenum, tungsten, cobalt, boron, carbon, and combinations thereof;

wherein said article has a hardness gradated from a greater hardness at its surface to a lesser hardness at its core and a density of at least about 95% of theoretical.

13. An article in accordance with claim 7 wherein the weight ratio of tungsten to titanium in said hard phase is about 1:3 to about 3:1.

14. An article in accordance with claim 13 wherein said ratio of tungsten to titanium is about 0.6:1 to about 1.5:1.

15. An article in accordance with claim 7 wherein said article is coated with one or more adherent, compositionally distinct layers, each layer being selected from the group consisting of a carbide, nitride and carbonitride of titanium, tantalum and hafnium, an oxide of aluminum, an oxide of zirconium, and mixtures and solid solutions thereof.

16. An article in accordance with claim 7 wherein said hard phase has an average grain size of about 0.5–20 μm.

17. An article in accordance with claim 16 wherein said hard phase has an average grain size of about 0.5–5.0 μm, and said article is of a geometry suitable for use as a cutting tool.

18. An article in accordance with claim 16 wherein said article is coated with one or more adherent, compositionally distinct layers, each layer being selected from the group consisting of a carbide, nitride and carbonitride of titanium, tantalum and hafnium, an oxide of aluminum, an oxide of zirconium, and mixtures and solid solutions thereof.

* * * * *